United States Patent [19]

Guess

[11] Patent Number: 4,561,454

[45] Date of Patent: Dec. 31, 1985

[54] SMOKING ARTICLE HAVING REDUCED SIDESTREAM SMOKE

[75] Inventor: Hal E. Guess, Winston-Salem, N.C.

[73] Assignee: R. J. Reynolds Tobacco, Winston-Salem, N.C.

[21] Appl. No.: 620,538

[22] Filed: Jun. 15, 1984

Related U.S. Application Data

[63] Continuation of Ser. No. 339,593, Jan. 15, 1982, abandoned.

[51] Int. Cl.[4] ..... A24D 1/02; A24D 1/18; D21H 5/16

[52] U.S. Cl. ..... 131/365; 131/334

[58] Field of Search ..... 131/365, 331, 334, 335

[56] References Cited

U.S. PATENT DOCUMENTS

| | | | |
|---|---|---|---|
| 2,091,598 | 8/1937 | Lanfry | 131/36 |
| 3,395,714 | 6/1964 | Kahane | 131/365 |
| 3,586,005 | 6/1971 | Lippman, Jr. et al. | 131/365 |
| 3,633,589 | 2/1970 | Kahane et al. | 131/365 |
| 3,744,496 | 7/1973 | McCarty et al. | 131/365 |
| 3,902,504 | 9/1975 | Owens, Jr. et al. | 131/365 |
| 3,908,671 | 9/1975 | Cogbill, II | 131/365 |
| 4,129,134 | 12/1978 | Hind et al. | 131/365 |
| 4,225,636 | 9/1980 | Cline et al. | 427/243 |
| 4,231,377 | 11/1980 | Cline et al. | 131/365 |

OTHER PUBLICATIONS

Resnik, et al., "Factors Affecting Static Burning Rate" 21 *Tobacco Science* 103 (1977).

Jodl, "Effect of Burning Additives of Cigarette Paper on Burning Rate of Cigarettes" 5(1) *Beitr. Trobakforsch* 22 (1969) (translation attached).

*Primary Examiner*—V. Millin

*Assistant Examiner*—Greg Beaucage

*Attorney, Agent, or Firm*—Grover M. Myers

[57] ABSTRACT

The sidestream smoke emanated by a smoking article, such as a cigarette, can be significantly reduced by constructing the smoking article with a double wrapper, one of the wrappers having alkali metal salt burning additives in an amount in the range from about 9 to 20% by weight. A commercially feasible reduced sidestream cigarette can be produced according to this invention, having both wrappers made from a low-porosity flax base, with the inner wrapper containing 11% and the outer wrapper 6% potassium citrate.

5 Claims, 4 Drawing Figures

SMOKING ARTICLE HAVING REDUCED SIDESTREAM SMOKE

This application is a a continuation of application Ser. No. 339,593 filed Jan. 15, 1982, now abandoned.

BACKGROUND OF THE INVENTION

This invention relates to smoking articles, such as cigarettes and cigars, and more particularly to smoking articles having an improved wrapping system, which produces a significant reduction in visible sidestream smoke without impairing the characteristics which allow for smoker acceptance and manufacturing feasibility.

A burning cigarette produces combustion products which exist in two phases. A gaseous phase consists of gases, such as $CO_2$, and a particulate phase consists of droplets of high molecular weight products of thermal degradation. The particulate phase is visible and makes up what is normally referred to as "cigarette smoke."

Further, the smoke can be divided into two components. One is the mainstream smoke, the smoke which passes lengthwise through the cigarette to the smoker. The other is sidestream smoke, the smoke emitted into the atmosphere by a cigarette during static burning between puffs. Sidestream smoke constitutes a potential source of annoyance to the smoker and others in the vicinity. The growing awareness of this problem can be seen readily in the widespread passage of laws restricting smoking in public places. Therefore, significant market potential exists for a cigarette which would substantially reduce the amount of sidestream smoke.

The real need, however, is not simply for a cigarette with reduced sidestream characteristics. To be successful in the marketplace, the cigarette must also be acceptable to the consumer and readily adaptable to mass production manufacturing. A reduced-sidestream cigarette must meet the following four criteria to be commercially acceptable:

1. First, the cigarette must reduce sidestream smoke to such a degree that smokers not only can perceive the reduction, but also perceive the reduction as a desirable product benefit. Market research has been conducted to determine the degree of reduction necessary for this result. As this research shows, a minimum reduction of 50% of the visible sidestream smoke is necessary to achieve consumer acceptance. At the other extreme, a reduction of over 80 to 90% is undesirable, because the smoker wants to be able to determine whether the cigarette is lit. Also, it is suspected that the particulate portion of sidestream smoke may contribute to the annoyance of the smoker and others. Therefore, a reduced-sidestream product also should reduce sidestream particulate levels.
2. The cigarette must exhibit acceptable taste characteristics. Smokers will not accept a persistent off-taste in order to achieve a reduction in sidestream smoke. A feasible product must achieve taste parity with existing products.
3. The cigarette must exhibit acceptable performance characteristics. Such characteristics include puff count, burn continuity, ashing characteristics, and mainstream smoke delivery (e.g., "tar", nicotine). The consumer must perceive that the reduced-sidestream cigarette behaves similarly to "normal" cigarettes. It must deliver approximately the same number of puffs per cigarette, it must stay lit between puffs, and the ash must be sufficiently firm to maintain integrity, yet not interfere with normal smoking. Furthermore, modern consumers demand reduced levels of "tar" and nicotine, and would reject a product which failed to achieve parity for these parameters with current cigarette brands.
4. The cigarette must be readily adaptable to mass production manufacturing techniques. Only through high-speed production can a cigarette be introduced to a mass market. Therefore, a reduced-sidestream product must not present undue difficulties in manufacturing. Areas of concern include tobacco blend composition, wrapper configuration, and demands for increased set-up time on cigarette making machines.

Two general approaches may be taken to the sidestream smoke problem. One is to reduce the total amount of sidestream material generated. This could be accomplished by reducing the amount of tobacco consumed during the smolder period between puffs, or by reducing the amount of smoke generated during combustion. Owens disclosed a cigarette incorporating a tobacco substitute, such as shredded carbon filled paper, in U.S. Pat. No. 3,902,504. The failure of cigarette manufacturers to produce a tobacco substitute that is acceptable to smokers, however, has prevented development of this concept.

Another approach is to reduce the amount of visible sidestream material. Here, the total amount of material released into the atmosphere during static burning may not be affected, but the droplets which constitute the particulate phase are reduced and the resultant stream is rendered invisible. The resulting smoke is thought to be less irritating, and thus less objectionable to consumers. This approach has yielded several candidates for a practical reduced-sidestream cigarette.

Most proposals for reducing sidestream smoke have concentrated on modifying the cigarette wrapper. An early effort by Kahane proposed a double-wrapped cigarette, in which the inner wrapper is a low-temperature melting-point, heat-insulating plastic, with a conventional outer wrapper. This design was said to reduce the burning temperature of the cigarette and lengthen the low-temperature distillation zone, thus making it perform like a pipe or cigar, reducing alleged health hazards. Although not the object of the invention, reduced sidestream smoke was cited as a product advantage. Worry about possible toxicity of the plastic wrapper combustion products has prevented commercial exploitation of this idea. Lippman, in U.S. Pat. No. 3,586,005, proposed a wrapper coated with a metal, e.g., aluminum, iron, or tin. The coated wrapper forms an ash in a tubular, unbroken sheath around the burned and burning tobacco, restricting airflow to the area through the burning zone. Although Lippman sought merely to reduce the production of "tar" through improved combustion of the tobacco, this invention also probably would reduce sidestream smoke. Testing this product, however, reveals that the resulting ash is so solid that when a consumer attempts to dislodge it, the ash tends also to pull the burning coal with it, extinguishing the cigarette. See McCarty, U.S. Pat. No. 3,744,496. Thus, this product has been rejected for commercial exploitation.

A more promising candidate was proposed by McCarty, U.S. Pat. No. 3,744,496. This cigarette includes a double wrapper, the inner wrap being a special carbon-filled paper. This product does exhibit a reduction in sidestream smoke, but consumer testing revealed a persistent acrid taste when smoked. Also, the product presents manufacturing difficulties stemming from the carbon-filled paper. The paper has proved difficult to adapt to cigarette-making machines, and tends to produce a high level of carbon dust in the work atmosphere. Thus, this development has not received commercial acceptance.

A completely new type of wrapper was proposed by Hind, U.S. Pat. No. 4,129,134. This wrapper consists of a single-layer polysaccharide film, and reduction of sidestream smoke is cited as one result. The resulting product does not look like a "normal" cigarette, however, and consumer preference for a product similar to existing cigarettes seems to have precluded development of this idea.

A single wrapper consisting of a paper containing magnesium oxides was advanced by Cline, U.S. Pat. No. 4,231,377. Testing has shown that this product does reduce sidestream smoke, but at the cost of an off-taste to consumers. Also, the product exhibits "flyaway" ash, which consumers perceive as a detriment.

Thus, twenty years of effort have produced no result. The simple fact that no commercially acceptable reduced-sidestream cigarette exists testifies eloquently to the ultimate failure of the prior art.

The present invention finds unexpected and surprising results in two areas of cigarette design, the wrapper configuration and burn additives. It is thus instructive to determine what the prior art teaches in each of these fields.

Although some proposals for reduced-sidestream cigarettes incorporate a double wrapper, no teaching suggests a cause and effect relationship.

Kahane proposed two cigarette configurations in U.S. Pat. Nos. 3,633,589 and 3,395,714. The '589 patent suggested a composite wrapper in which the sheets consisted of vegetable fiber stocks. The inner wrap was to be impervious to air, (such as a glassine or tracing paper) with the outer wrapper a conventional, porous sheet. This wrapper allegedly enriched the mainstream smoke by restricting airflow through the burning zone. To accomplish this result, the inner wrapper burned very slowly, leaving unburnt inner wrap up to the edge of the burning zone. The outer wrapper functioned to maintain burn continuity, confer desired ashing qualities, and mask undesirable appearance caused by the translucent inner wrapper. Nowhere was reduced sidestream smoke mentioned. Also, this invention presents a problem, in that the impervious inner wrapper prevents all airflow to the tobacco rod, causing the cigarette to self-extinguish between puffs. The '714 patent, discussed above, did mention reduced sidestream, but the effect was attributed to reduced burning temperature and a lengthened low-temperature distillation zone behind the burning zone. Again, the conventional outer wrapper presumably was included for appearance and ashing qualities, as in the earlier patent.

In Owens, U.S. Pat. No. 3,902,304, discussed above, a double wrapper is disclosed, but this cigarette is formed of multiple sections, each containing differing amounts of carbonized filler material. Each section is individually wrapped, and the outer wrapper merely encloses and lends structural integrity to the final product.

The composite wrapper shown in McCarty, U.S. Pat. No. 3,744,496, discussed above, results again from the unconventional appearance of the inner wrapper. The carbon-filled paper used here has a gray color, probably objectionable to consumers. The patent discloses two advantages of the double wrapper: reduction of tobacco weight and normal cigarette appearance. Rather than teaching any effect from the double wrapper, the inventor speculates that the reduction in sidestream stems from increased burning temperature due to the carbon filler.

The magnesium oxide paper disclosed by Cline, U.S. Pat. No. 4,231,377, discussed above, may be used in a double wrap configuration, according to the disclosure. Again, the cited advantages of double wrapping are tobacco weight reduction and cigarette appearance. Reduction of sidestream is attributed solely to the special magnesium oxide paper.

The common thread running through prior art disclosures of double-wrapped cigarettes is that reduction of sidestream smoke requires paper modifications that negatively affect the burning characteristics or appearance of the wrapper. The prior art teaches that these problems can be solved by wrapping the modified paper with a conventional paper. Not one of the proposed solutions teaches that double wrapping itself affects sidestream smoke.

A second critical feature of the present invention is the effect of burn additives upon sidestream smoke. Here, the prior art is not simply silent on the subject, but rather it points an investigator away from the solution.

Burn additives (also called burn chemicals) are well-known in cigarette manufacture. Their use stems from the fact that tobacco and paper tend to burn unevenly, leaving a loose, black or "flyaway" ash. Chemicals are thus added to cigarette paper to maintain burn continuity, to promote even burning, and to produce a white, firm ash. Studies by Resnik, et al, and Jodl demonstrate that the most effective burn additives are alkali metal salts, primarily citrates, phosphates, nitrates, and acetates of sodium and potassium. See Resnik, et al, "Factors Affecting Static Burning Rate," 21 *Tobacco Science* 103 (1977); Jodl, "Effect of Burning Additives of Cigarette Paper on Burning Rate of Cigarettes," 5(1) *Beitr. Tabakforsch.* 22 (1969). These references disclose the specific effects of various salts, and teach their use in concentrations ranging from 0 to 3%. No mention is made of any possible effect upon sidestream smoke.

U.S. patents contain similar teaching. In an early reference, Lanfry, U.S. Pat. No. 2,091,598, regards the use of potassium nitrate for burn enhancement as well-known, and suggests substituting a hydrocarbon oil for it to alleviate alleged harmful combustion products and disagreeable taste. Similarly, Cogbill, in U.S. Pat. No. 3,908,671, proposed a thermo-plastic wrap to reduce nicotine delivery. To promote burning, he taught the addition of potassium nitrate in concentrations ranging from 1.5 to 2.8% by weight. He teaches that addition of over 2.8% potassium nitrate should not be used, because the cigarette would then burn too fast. Another non-conventional wrapper is shown in Hind, U.S. Pat. No. 4,129,134, discussed above. Here, the reduction of sidestream is caused by a "shrinking" of the wrapper at the char line. The film-forming ingredient is said to be combined with an alkaline earth metal, preferably magnesium carbonate or calcium carbonate, but no proportions as percentage of the overall film weight is taught. Further the disclosure lumps two separate chemical paper additives, the burn additives, such as the citrates, and "fillers", such as calcium carbonate, both of which have distinct functions in the cigarette paper.

Two patents disclose a role for burn additives in sidestream reduction, but they expressly teach that burn chemicals cannot act to reduce sidestream without other chemical additives. McCarty, U.S. Pat. No. 3,744,496, discussed above, discloses that burn chemicals such as alkali metal hydroxides, bicarbonates, and carbonates, among others, act "synergistically" with the carbon filler in the paper to reduce sidestream smoke. The use of conventional fillers, from the alkaline earth metal carbonate group, preferably calcium carbonate, also enhance the sidestream smoke reduction. The amount of burning chemical as a proportion of the paper basis weight was not disclosed; the paper was stated to have been treated with solutions of sodium carbonate ranging from 0.5% to 5% concentration, well within the parameters disclosed by other authority. A similar role for burning chemicals was disclosed by Cline, U.S. Pat. No. 4,231,377, discussed above. Here, the burning chemical was said to enhance the sidestream reduction effect of the magnesium oxide paper filler. According to the disclosure, "neither magnesium oxide nor the chemical adjuvant salts when used alone as a filler or coating in smoking article wrappers substantially reduce sidestream smoke." The disclosure focused upon the use of sodium and potassium citrates and carbonates as burning chemicals in amounts ranging from 0 to 3.65% by weight.

The prior art can be summarized in three statements. First, no one has produced a commercially acceptable cigarette which exhibits reduced sidestream smoke characteristics. Second, no teaching exists which suggests that a double-wrapped cigarette would be particularly successful in reducing sidestream smoke. Third, the prior art teaches that burn additives, such as the alkali metal nitrates and citrates, cannot, by themselves, effectively reduce sidestream smoke.

SUMMARY OF THE INVENTION

It has been found that a commercially acceptable reduced-sidestream smoke cigarette can be produced by employing a double-wrap system, with at least one wrapper containing a super-high level of burning chemical, generally in a range from 9 to 20% by weight of an alkali metal salt.

An object of this invention is to provide a smoking article which emits substantially less sidestream smoke than does a conventional product.

Another object of this invention is to provide a reduced sidestream cigarette which meets cigarette industry criteria for commercial exploitation.

DETAILED DESCRIPTION OF THE INVENTION

Combustion of tobacco smoking products is a process still not completely understood, despite years of research. Although the major variables can be listed, their precise inter-relationships cannot be explained in detail. The present invention utilizes several of these parameters in a novel combination to produce an unexpected result.

Figures 1, 2, 3:
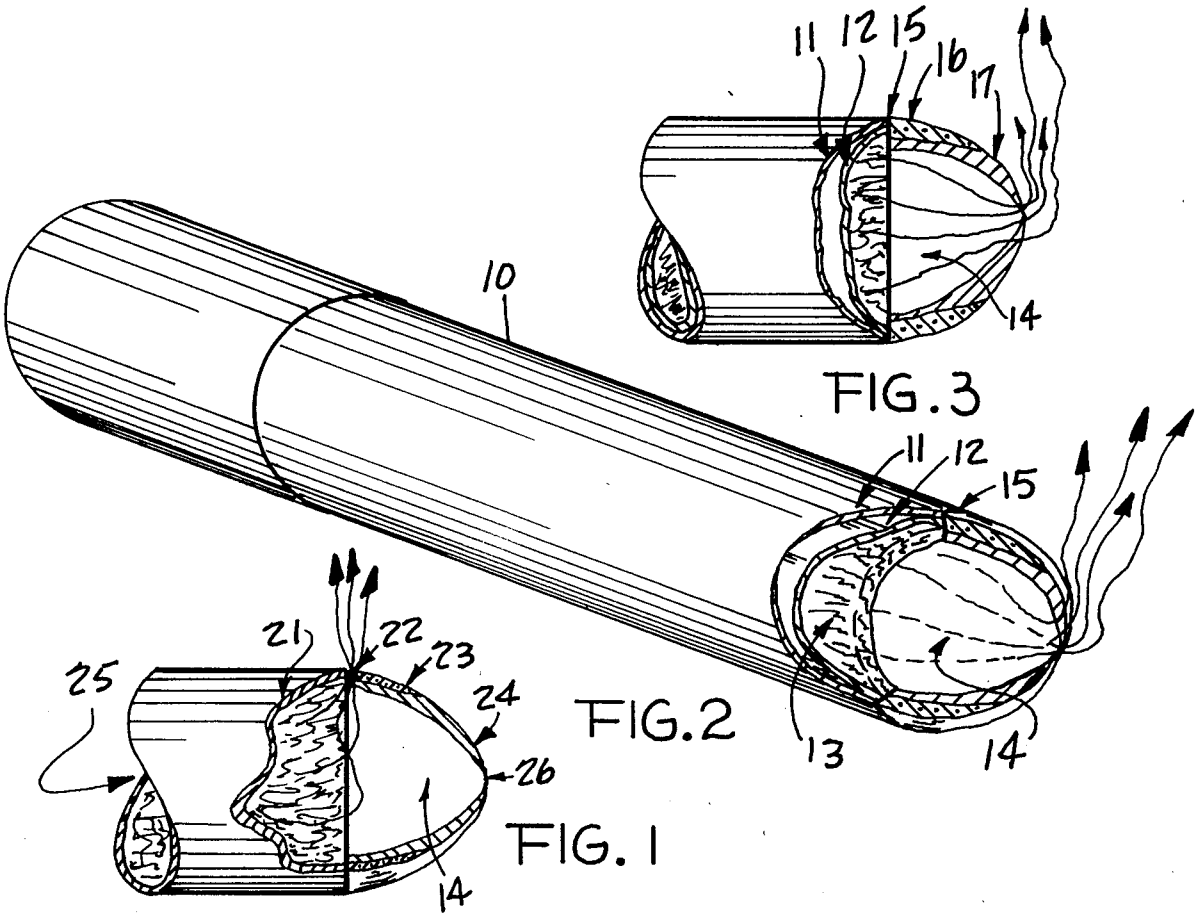
FIG. 1 is a side cutaway view of the burning end of a conventional single-wrap cigarette, showing the sidestream smoke path.
FIG. 2 depicts a reduced-sidestream smoke cigarette according to the present invention, with the forward end of the cigarette cut away to reveal the double wrapper, the tobacco rod, the burning zone, and the ash.
FIG. 3 is a cutaway view of the burning end of a reduced-sidestream cigarette according to the present invention.

FIG. 1 shows the combustion area of a typical smoking article, such as a single-wrap cigarette. The cigarette itself comprises a tobacco rod 25 encapsulated within a paper wrapper 21. The combustion area comprises three distinct zones. The burning zone 14 consists of the area where combustion occurs. Extending behind the burning zone for several millimeters is the pyrolysis zone. Here, pyrolysis occurs, as heat from the burning zone breaks down the tobacco and the paper wrapper into their constituent components. The cigarette ash encloses the burning zone, extending from the char line 22 to the tip of the cigarette 26. Two distinct types of ash are formed. The tobacco ash 24 is generally loose, flaky, and dark-colored. The paper ash 23 has a whitish color and is relatively firm.

Cigarette smoke can be analyzed from two aspects. From one point of view, the smoke is produced in two components. Mainstream smoke is produced when the smoker draws on the cigarette, and it flows lengthwise down the tobacco rod to the smoker. Sidestream smoke emanates into the atmosphere from the end of the cigarette. From another aspect, both of these components comprise two phases. A gaseous phase consists of gases, such as $CO_2$. It results from relatively complete combustion within the burning zone 14. A particulate phase consists of droplets of high-molecular weight compounds. The familiar plume of smoke arising from the tip of a cigarette is the particulate phase of sidestream smoke, or visible sidestream smoke. It is produced by thermal degradation within the pyrolysis zone, and it exits into the atmosphere by passing through the cigarette wrapper and paper ash at and immediately behind the char line 22.

A cigarette 10 which produces significantly less sidestream smoke according to the present invention is shown in FIG. 2. This cigarette consists of a conventional tobacco rod 13, enclosed within a two-layer wrapper, an outer wrap 11 and an inner wrap 12. Most constituents of the two wrappers may be varied widely, according to principles well-known in the art, but at least one of the wrappers must contain an elevated level of a burning chemical. The critical parameters are discussed in more detail hereafter. Further, the smoking article may utilize other well-known techniques to control smoking properties. For example, filtration or air dilution may be included to control "tar" and nicotine levels. Similar design variables will be obvious to those skilled in the art.

Although the mechanism by which the present invention reduces sidestream smoke is not established with certainty, FIG. 3 depicts the best hypothesis for the result. As shown therein, the burning zone 14 is enclosed within the paper ash 16 and tobacco ash 17. The paper ash seems to be especially hard and impervious to air flow. The result is to block the emanation of the material that ultimately forms the particulate phase of the sidestream smoke from the vicinity of the char line 15. The material is forced into the burning zone 14, where they are reduced into lower molecular weight compounds, which exit through the tobacco ash 17, primarily as gaseous, invisible sidestream smoke. The parameters underlying this effect are more fully discussed in connection with the examples of the invention.

Two embodiments of the invention have been prepared and tested against two control cigarettes. Tables I and II show, respectively, the physical properties of the wrappers of the tested cigarettes and the test results. All four tested cigarettes had the same tobacco blend, so that the only variable was the cigarette wrapper. Control 1 was a conventional 85 mm cigarette, widely marketed under the trademark WINSTON. It had a single wrapper, consisting of a paper available from suppliers such as Schweitzer Division of Kimberly-Clark Corporation, Ecusta Paper Division of Olin Corporation, and others under the designation "719." Control 2 was double-wrapped with conventional cigarette paper, available from suppliers under the designation "853."

Examples 1 and 2 incorporate the present invention. Example 1 has an inner wrapper based upon a reconstituted tobacco stock normally used on small cigars. The outer wrap is a conventional "853" paper. Example 2 has two special paper wrappers, developed by employing the lesson learned from Example 1 to produce a commercially feasible, reduced-sidestream cigarette.

Testing of these products focused upon the characteristics necessary to produce a commercially feasible product. As discussed above, two aspects of sidestream smoke reduction are important. First, the visible sidestream smoke must be reduced by at least 50%. Second, it is desirable to reduce the "tar" content of sidestream smoke as much as possible. To measure these characteristics, the products were first smoked on a standard smoking simulator, well-known in the art. The sidestream smoke was collected in a box. To measure reduction of visible sidestream smoke, a light was passed through the box and detected by a photocell. The light intensity level before introduction of smoke was compared to that observed with sidestream smoke present, to produce an absorbence value, the amount of light absorbed by the sidestream smoke. Table II shows the absolute absorbance value for each product and the percent reduction from Control 1. The sidestream smoke was also analyzed to determine "tar" content, using the technique described by C. H. Sloan and J. G. Curran, in "Spectrophotometric Determination of Filtration Efficiency of Cigarette Filters," *Tobacco Science* (May 21, 1981). Table II shows milligrams of sidestream "tar" and percent reduction from Control I.

TABLE I

| | Physical Properties of Tested Wrappers (Inner/Outer) | | | | |
|---|---|---|---|---|---|
| | Burning Chemical | | | | |
| Product | Type | Percent (Wt) | Thickness (Microns) | Porosity (Coresta) | Basis Weight (Gm/M$^2$) |
| Control 1 (Single-wrap) | Potassium Citrate | 1.7 | 410 | 29 | 25 |
| Control 2 (Double-wrap) | Potassium Citrate (both) | .7/.7 | 400/400 | 44/44 | 25/25 |
| Example 1 | Potassium Nitrate/ | 17/.7 | 630/400 | 27/44 | 45/25 |

TABLE I-continued

| | Physical Properties of Tested Wrappers (Inner/Outer) | | | | |
|---|---|---|---|---|---|
| | Burning Chemical | | | | |
| Product | Type | Percent (Wt) | Thickness (Microns) | Porosity (Coresta) | Basis Weight (Gm/M$^2$) |
| Example 2 | Potassium Citrate Potassium Citrate (both) | 11/6 | 538/358 | 6/6 | 36/24 |

TABLE II

| | Reduction of Sidestream Smoke | | | |
|---|---|---|---|---|
| | Visible Sidestream | | Sidestream Tar | |
| Product | Absorbence Value | Percent Reduction | Mg. | Percent Reduction |
| Control 1 (Single-Wrap) | .599 | — | 23.0 | — |
| Control 2 (Double-Wrap) | .411 | 31.4 | 17.6 | 23.4 |
| Example 1 | .288 | 51.9 | 12.2 | 46.9 |
| Example 2 | .296 | 50.5 | 15.0 | 34.7 |

Comparing the results achieved by Example 1 with those of Control 2, it is apparent that substitution of special paper in the inner wrapper produces dramatic and unexpected results. As shown in Table II, the Control 2 product (double-wrapped with conventional paper) did reduce sidestream smoke and tar somewhat, but not to commercially feasible levels. In addition, the double wrapper imparted an unpleasant "papery" taste to the smoke. In contrast, Example 1 boosted the visible sidestream reduction beyond 50%, and cut sidestream smoke tar almost in half without sacrificing taste. No explanation for this result was apparent from conventional knowledge. Analyzing the physical characteristics of Control 1, Control 2 and Example 1, the most striking difference is the superabundance of burning chemical, potassium nitrate, within the special paper. The elevated level of potassium nitrate within the special paper was entirely serendipitous, because it had not been added to promote burning; rather its presence was due to treatment of the paper with tobacco extracts to enable it to perform as a small cigar, and those extracts contained high levels of potassium nitrate.

The Example 1 inner wrapper was tested thoroughly to determine what constituents contributed to the reduction of visible sidestream. This analysis isolated the burning chemical as the responsible constituent. Thereafter, it was possible to dispense with the other special constituents of the Example 1 inner wrapper, all of which contributed to a relatively high manufacturing cost. The Example 2 inner wrapper is thus very similar to conventional paper except for the high level of potassium citrate. The preferred embodiment employs a flax based paper, but a wood cellulose or other well-known base could also be used, as would be readily appreciated by those skilled in the art.

Experimentation with the parameters of the double-wrap system shown in Example 1 led to the development of Example 2. Development focused upon the burning chemical level and composition. Although any of the well-known burning additives will produce the desired effect, potassium citrate proved to be the optimum choice. It was also found during experimentation that the relatively high thickness and basis weight of the Example 1 inner wrap enhanced the reduction of visible sidestream smoke. Because basis weight affects the amount of cigarette wrapper which can be mounted on a bobbin for use in a high-speed cigarette making machine, an attempt was made to reduce the basis weight of the Example 2 inner wrap. Reducing the porosity of the Example 2 wrap allowed the production of a paper which has significantly reduced basis weight when compared to the Example 1 inner wrap, and is thus more readily adaptable to high-speed production.

Figure 4:
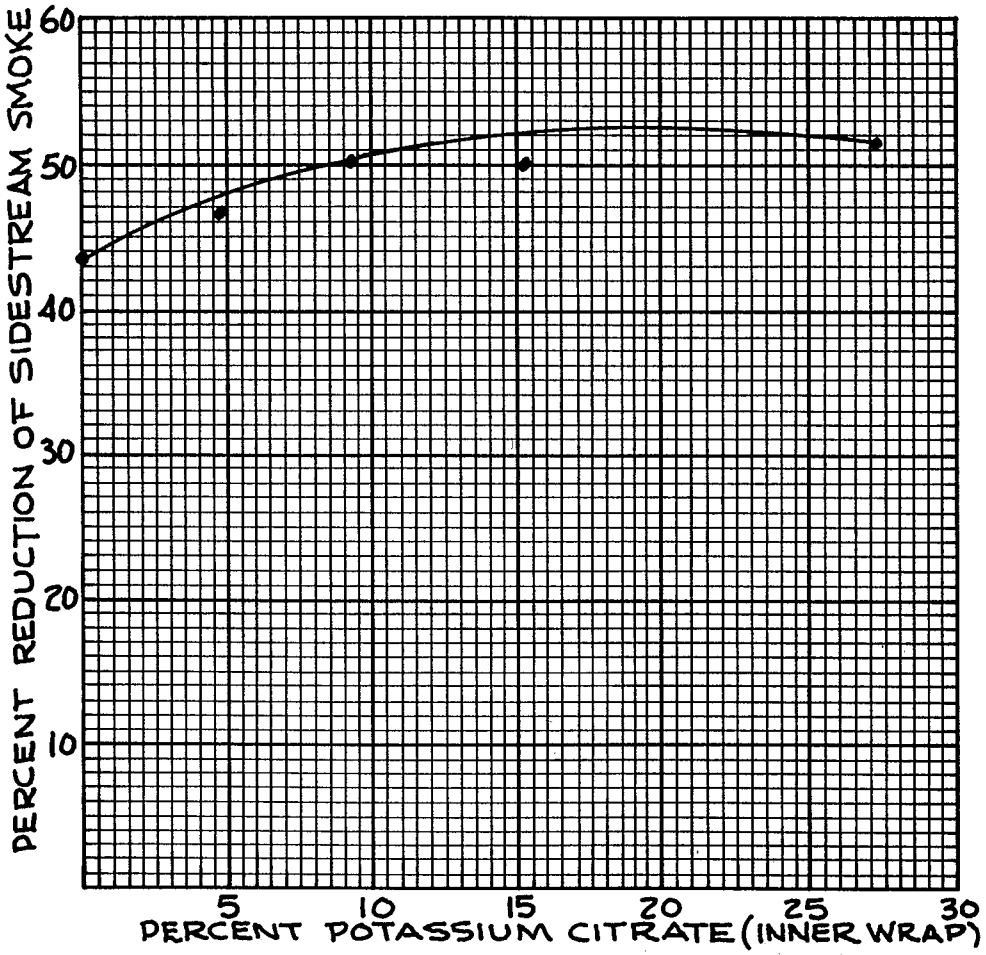
FIG. 4 shows the variation in production of visible sidestream smoke as a function of the percentage of potassium citrate present in the inner wrapper of the present invention.

Analysis also determined the level of burning chemical required to produce a significant reduction in visible sidestream smoke. FIG. 4 charts reduction of sidestream smoke as a function of the percentage of potassium citrate (by weight) in the inner wrapper of Example 2. As revealed there, a concentration of about 9% by weight is required to reach a 50% reduction of visible sidestream. Reduction seems to be maximized at about 20% concentration. Other experimentation confirmed that the desired concentration falls within the range of 9–20%.

The Example 2 outer wrap more closely corresponds to conventional cigarette paper in terms of basis weight and thickness, but it emobodies the teaching of Example 1 in having a low porosity and a relatively high level of burning chemical. It was found during development that having very high (over 9%) levels of burning chemical in both wrappers resulted in reduced sidestream, but at a cost of imparting a cigar-like taste to the cigarette. Also, a product having an inner wrapper with little to no burning chemical and an outer wrapper with high levels was found to produce the reduced sidestream effect, but only at citrate levels around 20%. At such high levels of burning additive, however, paper manufacturing difficulties appear.

The real test of this product came in its evaluation by smokers. Application of the teaching of this invention to well-known cigarette design techniques, such as filtration and air dilution, resulted in the production of a cigarette which delivers the same range of puffs per cigarette as does a conventional product, has a satisfactory ash, and exhibits "tar" and nicotine levels in the "low tar" category. As to the all-important criterion of cigarette taste, consumer focus groups rated this cigarette at parity with several existing cigarette brands.

This invention has made possible the achievement of a long-sought goal of the cigarette industry. By disregarding "common wisdom" of the prior art, this invention enabled the production of a commercially viable reduced-sidestream smoke cigarette.

The embodiments shown herein can be modified in various ways, as are obvious to those skilled in the art. Not only cigarettes, but also cigars, cigarillos and other smoking articles may incorporate this invention. Filtration, air dilution, and other techniques may be employed to control smoking parameters. Further, use of a substitute for tobacco within the smoking article would not affect the operation of the invention. Therefore, it should be understood that the use of "tobacco" in the specification and claims herein also embraces "tobacco substitute." These and other variations can be made without departing from the spirit of the invention defined in the following claims.

I claim:

1. A smoking article, comprising a tobacco charge, an inner wrapper, and an outer wrapper, said wrappers consisting essentially of a web of cellulosic material and an inorganic filler, wherein one of said wrappers additionally contains an alkali metal salt in a range of about 9–20% by weight.

2. The smoking article of claim 1, wherein both wrappers contain at least 9% by weight of an alkali metal salt.

3. The smoking article of claim 1, wherein said alkali metal salt is potassium nitrate.

4. The smoking article of claim 1, wherein said alkali metal salt is potassium citrate.

5. The smoking article of claim 1, 3, or 4, wherein said wrapper containing said alkali metal salt is the inner wrapper.

* * * * *